US009568226B2

(12) United States Patent
Schuster et al.

(10) Patent No.: US 9,568,226 B2
(45) Date of Patent: Feb. 14, 2017

(54) REFRIGERANT CHARGE INDICATION

(75) Inventors: Don A. Schuster, Lindale, TX (US); Sathish R. Das, Indianapolis, IN (US)

(73) Assignee: CARRIER CORPORATION, Farmington, CT (US)

( * ) Notice: Subject to any disclaimer, the term of this patent is extended or adjusted under 35 U.S.C. 154(b) by 2163 days.

(21) Appl. No.: 12/519,652

(22) PCT Filed: Dec. 20, 2006

(86) PCT No.: PCT/US2006/048573

§ 371 (c)(1),
(2), (4) Date: Dec. 9, 2009

(87) PCT Pub. No.: WO2008/079108

PCT Pub. Date: Jul. 3, 2008

(65) Prior Publication Data

US 2010/0089076 A1 Apr. 15, 2010

(51) Int. Cl.
*F25B 45/00* (2006.01)
*F25B 49/00* (2006.01)

(52) U.S. Cl.
CPC ..... *F25B 49/005* (2013.01); *F25B 45/00* (2013.01); *F25B 2345/00* (2013.01);
(Continued)

(58) Field of Classification Search
CPC ..... F25D 29/00; F25D 2700/00; F25D 45/00; F25D 2345/00; F25D 2600/05; F25D 2700/04; F25B 2700/00
(Continued)

(56) References Cited

U.S. PATENT DOCUMENTS 3,754,442 A * 8/1973 Arnett ..... 374/173
4,038,061 A * 7/1977 Anderson et al. ..... 62/126
(Continued)

FOREIGN PATENT DOCUMENTS

EP 0159281 10/1985
EP 0289369 11/1988
(Continued)

OTHER PUBLICATIONS

International Preliminary Report on Patentability mailed Jun. 8, 2011.
(Continued)

*Primary Examiner* — Jianying Atkisson
*Assistant Examiner* — David Teitelbaum
(74) *Attorney, Agent, or Firm* — Cantor Colburn LLP

(57) ABSTRACT

A method and apparatus are provided for indicating the status of the refrigerant charge in an air conditioning system based upon the degree of subcooling present in the condensed refrigerant system temperature measurements. The status of the refrigerant charge in the system is indicated in real-time on a service panel for access by a field service technician. The status of the refrigerant charge in the system on a time-average basis for a specified period of operation is presented on an indicator panel. The indicator panel includes a first indicator light indicating that the refrigerant charge is low, a second indicator light indicating that the refrigerant charge is high, and a third indicator light indicating that the refrigerant charge is correct.

9 Claims, 1 Drawing Sheet

(52) U.S. Cl.
CPC ..... *F25B 2600/05* (2013.01); *F25B 2700/00* (2013.01); *F25B 2700/04* (2013.01)

(58) Field of Classification Search
USPC ..... 62/127, 149, 77
See application file for complete search history.

(56) References Cited

U.S. PATENT DOCUMENTS

| | | | | |
|---|---|---|---|---|
| 4,114,448 | A | 9/1978 | Merritt | |
| 4,304,126 | A | 12/1981 | Yelke | |
| 4,325,223 | A | 4/1982 | Cantley | |
| 4,381,549 | A | 4/1983 | Stamp, Jr. et al. | |
| 4,429,578 | A | 2/1984 | Darrel et al. | |
| 4,510,576 | A | 4/1985 | MacArthur et al. | |
| 4,541,284 | A | 9/1985 | Guagliumi et al. | |
| 4,546,616 | A | 10/1985 | Drucker | |
| 4,561,261 | A | 12/1985 | Kornrumpf et al. | |
| 4,624,112 | A | 11/1986 | Proctor | |
| 4,677,830 | A | 7/1987 | Sumikawa et al. | |
| 4,745,519 | A | 5/1988 | Breidegam | |
| 4,798,055 | A | 1/1989 | Murray et al. | |
| 4,805,416 | A | 2/1989 | Manz et al. | |
| 4,829,777 | A | 5/1989 | Matsuoka et al. | |
| 4,841,734 | A | 6/1989 | Torrence | |
| 4,856,288 | A | 8/1989 | Weber | |
| 4,982,576 | A | 1/1991 | Proctor et al. | |
| 5,016,472 | A | 5/1991 | Amrhein et al. | |
| 5,046,322 | A | 9/1991 | Bulla et al. | |
| 5,057,965 | A | 10/1991 | Wilson | |
| 5,079,930 | A | 1/1992 | Beaverson et al. | |
| 5,156,012 | A | 10/1992 | Kuribara et al. | |
| 5,186,012 | A | 2/1993 | Czachorski et al. | |
| 5,186,014 | A * | 2/1993 | Runk | 62/129 |
| 5,206,963 | A | 5/1993 | Wiens | |
| 5,214,918 | A | 6/1993 | Oguni et al. | |
| 5,228,304 | A | 7/1993 | Ryan | |
| 5,239,865 | A | 8/1993 | Salzer et al. | |
| H1226 | H | 9/1993 | VanReenen et al. | |
| 5,241,833 | A | 9/1993 | Ohkoshi | |
| 5,248,168 | A | 9/1993 | Chichester et al. | |
| 5,251,453 | A | 10/1993 | Stanke et al. | |
| 5,295,360 | A | 3/1994 | Olds et al. | |
| 5,317,903 | A | 6/1994 | McClelland et al. | |
| 5,341,649 | A | 8/1994 | Nevitt et al. | |
| 5,354,103 | A | 10/1994 | Torrence et al. | |
| 5,362,530 | A | 11/1994 | Kitami et al. | |
| 5,374,084 | A | 12/1994 | Potokar | |
| 5,381,669 | A | 1/1995 | Bahel et al. | |
| 5,406,980 | A | 4/1995 | Allread et al. | |
| 5,413,147 | A | 5/1995 | Moreiras et al. | |
| 5,423,189 | A | 6/1995 | Nicol et al. | |
| 5,425,558 | A | 6/1995 | Dennany, Jr. | |
| 5,430,692 | A | 7/1995 | Grupp et al. | |
| 5,463,377 | A | 10/1995 | Kronberg | |
| 5,464,042 | A | 11/1995 | Haunhorst | |
| 5,465,588 | A * | 11/1995 | McCahill et al. | 62/127 |
| 5,468,028 | A | 11/1995 | Olson | |
| 5,474,336 | A | 12/1995 | Hoff et al. | |
| 5,540,463 | A | 7/1996 | Potokar | |
| 5,586,445 | A | 12/1996 | Bessler | |
| 5,694,778 | A | 12/1997 | Wilson | |
| 5,752,726 | A | 5/1998 | Fixemer | |
| 5,807,332 | A | 9/1998 | Augustine et al. | |
| 5,834,943 | A | 11/1998 | Miller | |
| 5,860,286 | A | 1/1999 | Tulpule | |
| 5,868,437 | A | 2/1999 | Teague | |
| 5,961,157 | A | 10/1999 | Baron et al. | |
| 5,987,903 | A * | 11/1999 | Bathla | 62/129 |
| 6,012,743 | A | 1/2000 | Godeau et al. | |
| 6,045,742 | A | 4/2000 | McGrevy | |
| 6,101,820 | A | 8/2000 | Cheballah | |
| 6,155,612 | A | 12/2000 | Szabo | |
| 6,161,394 | A | 12/2000 | Alsenz | |
| 6,179,214 | B1 | 1/2001 | Key et al. | |
| 6,302,654 | B1 | 10/2001 | Millet et al. | |
| 6,308,523 | B1 | 10/2001 | Scaringe | |
| 6,324,854 | B1 | 12/2001 | Jayanth | |
| 6,330,802 | B1 | 12/2001 | Cummings et al. | |
| 6,354,332 | B1 | 3/2002 | Burkhardt et al. | |
| 6,382,678 | B1 | 5/2002 | Field et al. | |
| 6,442,953 | B1 | 9/2002 | Trigiani et al. | |
| 6,460,354 | B2 | 10/2002 | Yabuki et al. | |
| 6,463,747 | B1 | 10/2002 | Temple | |
| 6,470,695 | B2 | 10/2002 | Gong | |
| 6,481,756 | B1 | 11/2002 | Field et al. | |
| 6,497,435 | B1 | 12/2002 | Luft et al. | |
| 6,546,823 | B1 | 4/2003 | Veit | |
| 6,550,341 | B2 | 4/2003 | van Schoor et al. | |
| 6,553,774 | B1 | 4/2003 | Ishio et al. | |
| 6,571,566 | B1 * | 6/2003 | Temple et al. | 62/129 |
| 6,594,554 | B1 | 7/2003 | Seem et al. | |
| 6,658,373 | B2 | 12/2003 | Rossi et al. | |
| 6,735,964 | B2 | 5/2004 | Perkovich et al. | |
| 6,758,051 | B2 | 7/2004 | Jayanth et al. | |
| 6,769,258 | B2 | 8/2004 | Pierson | |
| 6,843,070 | B1 | 1/2005 | Suharno | |
| 6,868,678 | B2 * | 3/2005 | Mei et al. | 62/126 |
| 6,964,173 | B2 | 11/2005 | Dobmeier et al. | |
| 6,973,794 | B2 | 12/2005 | Street et al. | |
| 7,079,967 | B2 | 7/2006 | Rossi et al. | |
| 7,146,290 | B2 | 12/2006 | Triginai et al. | |
| 2002/0024218 | A1 | 2/2002 | Manuli | |
| 2002/0096209 | A1 | 7/2002 | Danielson et al. | |
| 2002/0121100 | A1 | 9/2002 | Yabuki et al. | |
| 2002/0139128 | A1 | 10/2002 | Suzuki et al. | |
| 2002/0141877 | A1 | 10/2002 | Jayanth et al. | |
| 2002/0182005 | A1 | 12/2002 | Milhas | |
| 2003/0051490 | A1 * | 3/2003 | Jayanth | 62/127 |
| 2003/0089119 | A1 | 5/2003 | Pham et al. | |
| 2003/0172665 | A1 | 9/2003 | Matsuoka et al. | |
| 2003/0182950 | A1 | 10/2003 | Mei et al. | |
| 2003/0226367 | A1 | 12/2003 | Palmer et al. | |
| 2004/0103673 | A1 * | 6/2004 | Hong | 62/129 |
| 2005/0040250 | A1 * | 2/2005 | Wruck | 236/51 |
| 2005/0229612 | A1 * | 10/2005 | Hrejsa | F25B 45/00 62/149 |
| 2005/0235755 | A1 | 10/2005 | Hindman | |

FOREIGN PATENT DOCUMENTS

| | | | |
|---|---|---|---|
| EP | 0308160 | | 3/1989 |
| EP | 0396029 | | 11/1990 |
| EP | 0409000 | | 1/1991 |
| EP | 0453302 | | 10/1991 |
| EP | 0529758 | | 3/1993 |
| EP | 0550263 | | 7/1993 |
| EP | 0760069 | | 3/1997 |
| EP | 0843794 | | 5/1998 |
| EP | 0918182 | | 5/1999 |
| EP | 1238838 | | 9/2002 |
| EP | 1337825 | | 8/2003 |
| FR | 2667570 | A1 | 4/1992 |
| GB | 2274695 | | 8/1994 |
| JP | 62218748 | | 9/1987 |
| JP | 62261845 | | 11/1987 |
| JP | 63302238 | | 12/1988 |
| JP | 2110268 | | 4/1990 |
| JP | 2195165 | | 8/1990 |
| JP | 455671 | | 2/1992 |
| JP | 4190062 | | 7/1992 |
| JP | 4273941 | | 9/1992 |
| JP | 599475 | | 4/1993 |
| JP | 5231754 | | 9/1993 |
| JP | 5256543 | | 10/1993 |
| JP | 755299 | | 3/1995 |
| JP | 868576 | | 3/1996 |
| JP | 8261542 | | 10/1996 |
| JP | 8261543 | | 10/1996 |
| JP | 20009048 | | 1/2000 |
| JP | 2000154954 | | 6/2000 |
| JP | 200132884 | | 2/2001 |
| JP | 2001141279 | | 5/2001 |
| WO | WO-9320376 | | 10/1993 |
| WO | WO-9530106 | | 11/1995 |

(56) References Cited

FOREIGN PATENT DOCUMENTS

| | | |
|---|---|---|
| WO | WO-9530107 | 11/1995 |
| WO | WO-9533157 | 12/1995 |
| WO | WO-9617202 | 6/1996 |
| WO | WO-9712167 | 4/1997 |
| WO | WO-9713994 | 4/1997 |
| WO | WO-9713995 | 4/1997 |
| WO | WO-9747908 | 12/1997 |
| WO | WO-0045053 | 8/2000 |
| WO | WO-0123794 | 4/2001 |

OTHER PUBLICATIONS

International Search Report and Written Opinion mailed Nov. 19, 2007 (8 pgs.).

* cited by examiner

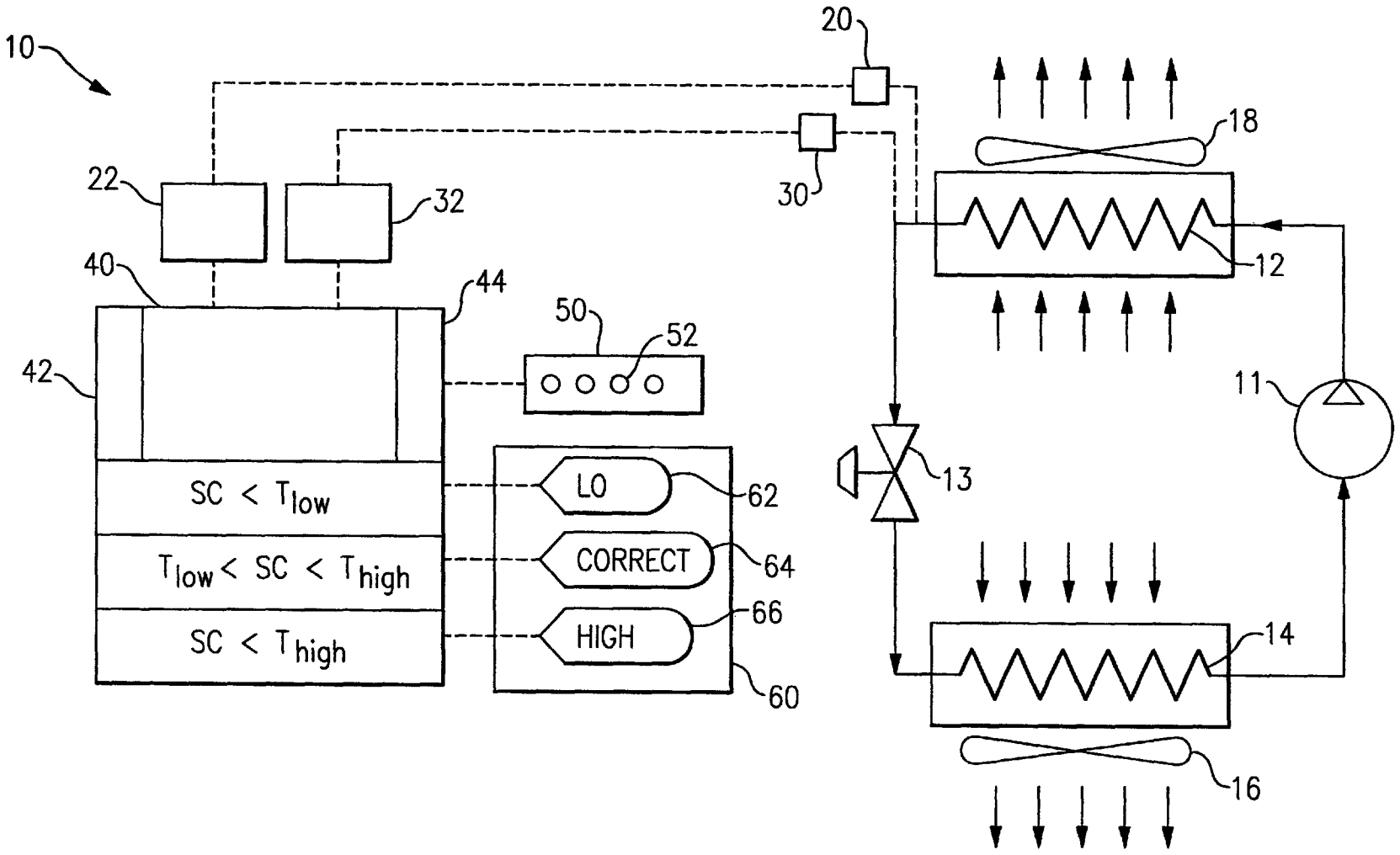
10
11
12
13
14
16
18
20
22
30
32
40
42
44
50
52
60
62
64
66
LO
CORRECT
HIGH
SC < T low
T low < SC < T high
SC < T high

REFRIGERANT CHARGE INDICATION

BACKGROUND OF THE INVENTION

This invention relates generally to refrigerant vapor compression systems for residential or light commercial air conditioning applications and, more particularly, to a method and apparatus for predicting the refrigerant charge in such systems.

Maintaining proper refrigerant charge level is essential to the safe and efficient operation of an air conditioning system. Improper charge level, either in deficit or in excess, can cause premature compressor failure. An over-charge in the system results in compressor flooding, which, in turn, may be damaging to the motor and mechanical components. Inadequate refrigerant charge can lead to reduced system capacity, thus reducing system efficiency. Low charge also causes an increase in refrigerant temperature entering the compressor, which may cause thermal over-load of the compressor. Thermal over-load of the compressor can cause degradation of the motor winding insulation, thereby bringing about premature motor failure.

Charge adequacy has traditionally been checked manually by trained service technicians using pressure gauge, temperature measurements and a pressure to refrigerant temperature relationship chart for the particular refrigerant resident in the system. For refrigerant vapor compression systems which use a thermal expansion valve (TXV), or an electronic expansion valve (EXV), the superheat of the refrigerant entering the compressor is normally regulated at a fixed value, while the amount of subcooling of the refrigerant exiting the condenser varies. Consequently, in such systems, the "subcooling method" is customarily used as an indicator for charge level. In this method, the amount of subcooling, defined as the saturated refrigerant temperature at the refrigerant pressure at the outlet of the condenser coil for the refrigerant in use, a.k.a. the refrigerant condensing temperature, minus the actual refrigerant temperature measured at the outlet of the condenser coil, is determined and compared to a range of acceptance levels of subcooling. For example, a subcool temperature range between 10 and 15° F. is generally regarded as acceptable in a refrigerant vapor compression system operating as a residential or light commercial air conditioner.

Typically, the technician measures the refrigerant pressure at the condenser outlet and the refrigerant line temperature at a point downstream with respect to refrigerant flow of the condenser coil and upstream with respect to refrigerant flow of the expansion valve, generally at the inlet to the expansion valve. With these refrigerant pressure and temperature measurements, the technician then refers to the pressure to temperature relationship chart for the refrigerant in use to determine the saturated refrigerant temperature at the measured pressure and calculates the amount of cooling actually present at the current operating conditions, that is outdoor temperature, indoor temperature, humidity, indoor airflow and the like. If the measured amount of cooling lies within the range of acceptable levels, the technician considers the system properly charged. If not, the technician will adjust the refrigerant charge by either adding a quantity of refrigerant to the system or draining a quantity of refrigerant from the system, as appropriate. Methods for determining the refrigerant charge level in an air conditioning system are disclosed in U.S. Pat. Nos. 5,239,865; 5,987,903; 6,101,820; and 6,571,566.

As operating conditions may vary widely from day to day, the particular amount of cooling measured by the field service technician at any given time may not be truly reflective of the amount of subcooling present during "normal" operation of the system. Thus, this charging procedure is also an empirical, time-consuming, and a trial-and-error process subject to human error. Therefore, the technician may charge the system with an amount of refrigerant that is not the optimal amount charge for "normal" operating conditions, but rather with an amount of refrigerant that is merely within an acceptable tolerance of the optimal amount of charge under the operating conditions at the time the system is charged. Therefore, it is desirable to provide a method and device for automatically indicating the status of the refrigerant charge within an operating system over a wide range of actual operating conditions. It is also desirable to provide a visual interface in association with such a device to indicate whether or not the system is properly charged.

SUMMARY OF THE INVENTION

A method and an apparatus are provided for indicating the level of refrigerant charge in a refrigerant vapor compression system via both a real-time indication and an average over time indication.

In one aspect of the invention, a method is provided for indicating the level of refrigerant charge in a refrigerant vapor compression system having a compressor, a condenser coil, an expansion device and an evaporator coil connected in serial relationship in refrigerant flow circuit. The method comprises the steps of: sensing the pressure of the refrigerant leaving the condenser coil and generating a first signal indicative of the sensed refrigerant pressure; sensing the temperature of the refrigerant downstream of the condenser coil and upstream of the expansion device and generating a second signal indicative of the sensed refrigerant temperature; calculating in real-time a value for the degrees of subcooling present based upon the sensed refrigerant pressure and the sensed refrigerant temperature; outputting an electrical signal indicative of the real-time value for the degrees of subcooling present; calculating an average value for the degrees of subcooling over a preselected time period of system operation; and outputting an indication of a refrigerant charge status over a preselected time period of system operation. In an embodiment, the step of outputting an indication of refrigerant charge status over a preselected time period of system operation comprises the step of outputting an indication of whether the refrigerant charge status is low, high or correct. In one embodiment, step of outputting an electrical signal indicative of the real-time value for the degrees of subcooling present comprises the step of outputting a milli-volt electrical signal indicative of the real-time value for the degrees of subcooling present.

In one embodiment of the method of the invention, the step of outputting an indication of refrigerant charge status over a preselected time period of system operation comprises the steps of: providing an acceptable range for the average value for the degrees of subcooling over a preselected time period of system operation extending from a low threshold level to a high threshold level; comparing the average valve for the degrees of subcooling over a preselected time period of system operation to the acceptable range therefor; and providing a refrigeration charge status indication reflecting one of: a low refrigerant charge if the average valve for the degrees of subcooling over a preselected time period of system operation is below the low threshold value, a high refrigerant charge if the average valve for the degrees of subcooling over a preselected time period of system operation is above the high threshold value, and a correct refrigerant charge if the average valve for the degrees of subcooling over a preselected time period of system operation lies within the acceptable range.

There are various methods to convey the computed charge level to the user. The primary method is a method using 3 LED's. The first LED indicating low on charge, a second indicating correct charge and a third to indicate over charge condition. Other methods are possible such as a single LED or other output indicating either incorrect or correct charge. A single LED could also indicate various levels by flashing codes for high or low.

The step of providing a refrigeration charge status indication reflecting one of a low refrigerant charge, a high refrigerant charge or a correct refrigerant charge may include illuminating a first light indicating a low refrigerant charge if the average valve for the degrees of subcooling over a preselected time period of system operation is below the low threshold value, illuminating a second light indicating a high refrigerant charge if the average valve for the degrees of subcooling over a preselected time period of system operation is above the high threshold value, and illuminating a third light indicating a correct refrigerant charge if the average valve for the degrees of subcooling over a preselected time period of system operation lies within the acceptable range.

In another aspect of the invention, an apparatus is provided for indicating the level of refrigerant charge in a refrigerant vapor compression system having a compressor, a condenser coil, an expansion device and an evaporator coil connected in serial relationship in refrigerant flow circuit. The apparatus includes a pressure sensor for sensing the pressure of the refrigerant leaving the condenser coil and generating a first signal indicative of the sensed refrigerant pressure, a temperature sensor for sensing the temperature of the refrigerant downstream of the condenser coil and upstream of the expansion device and generating a second signal indicative of the sensed refrigerant temperature, and a processor that receives and process the pressure and temperature signals. The processor calculates in real-time a value for the degrees of subcooling present based upon the sensed refrigerant pressure and the sensed refrigerant temperature and outputs a signal indicative of the real-time value for the degrees of subcooling present. Additionally, the processor calculates an average value for the degrees of subcooling over a preselected time period of system operation and outputs an indication of a refrigerant charge status over the preselected time period of system operation.

The apparatus may include a service panel for receiving the signal indicative of the real-time value for the degrees of subcooling present from the processor. The service panel includes a tap at which the electrical signal indicative of the real-time value for the degrees of subcooling present is presented. The apparatus may also include an indicator panel for receiving a signal from the processor indicative of the refrigerant charge status over the preselected time period of system operation. The indicator panel has a first indicator associated with a low refrigerant charge, a second indicator operatively associated with a high refrigerant charge, and a third indicator operatively associated with a correct refrigerant charge. In an embodiment, the first indicator is a first light adapted to be illuminate for indicating a low refrigerant charge, the second indicator is a second light adapted to be illuminated for indicating a high refrigerant charge, and the third indicator is a third light adapted to be illuminated for indicating a correct refrigerant charge.

In a particular embodiment, the apparatus includes a pressure sensor for sensing the pressure of the refrigerant leaving the condenser coil and generating a first analog signal indicative of the sensed refrigerant pressure, a temperature sensor for sensing the temperature of the refrigerant downstream of the condenser coil and upstream of the expansion device and generating a second analog signal indicative of the sensed refrigerant temperature, and a microprocessor that receives and process the pressure and temperature signals. A first analog-to-digital converter operatively associated with said pressure sensor converts the first analog signal into a first digital signal. A second analog-to-digital converter operatively associated with the temperature sensor converts the second analog signal into a second digital signal.

The microprocessor receives the first and second digital signals and calculates in real-time a value for the degrees of subcooling present based upon the sensed refrigerant pressure and the sensed refrigerant temperature and outputs a digital signal indicative of the real-time value for the degrees of subcooling present. A digital-to-analog converter converts the digital signal indicative of the real-time value for the degrees of subcooling present to a millivolt electrical signal. A service interface receives the millivolt electrical signal indicative of the real-time value for the degrees of subcooling present from said processor. The service interface has a tap at which the millivolt electrical signal indicative of the real-time value for the degrees of subcooling present is presented. The service technician uses this real-time information to charge the system with refrigerant and other troubleshooting procedures.

The microprocessor also calculates an average value for the degrees of subcooling over a preselected time period of system operation and outputs an indication of a refrigerant charge status over the preselected time period of system operation. An indicator panel receives a signal from said microprocessor indicative of the refrigerant charge status over the preselected time period of system operation. The indicator panel has a first light adapted to be illuminate for indicating a low refrigerant charge, a second light adapted to be illuminated for indicating a high refrigerant charge, and a third light adapted to be illuminated for indicating a correct refrigerant charge. This information may be used by the non service oriented persons as well as service persons.

BRIEF DESCRIPTION OF THE DRAWINGS

For a further understanding of these and objects of the invention, reference will be made to the following detailed description of the invention which is to be read in connection with the accompanying drawing, wherein:

FIG. 1 is a schematic illustration of an air conditioning system with present invention incorporated therein.

DESCRIPTION OF THE PREFERRED EMBODIMENT

Referring now to FIG. 1, the invention is shown generally as incorporated into a refrigerant vapor compression air conditioning system 10 having a compressor 11, a condenser coil 12, an expansion device 13 and an evaporator coil 14 connected in serial relationship in refrigerant flow communication in a conventional manner via refrigerant lines forming a refrigerant flow circuit. In operation, the refrigerant, for example R12, R22, R134a, R404A, R410A, R407C, R717, R744 or other compressible fluid, circulating through the refrigerant circuit passes through the evaporator coil 14 in the evaporator in heat exchange relationship with indoor air being passed over the evaporator coil 14 by the evaporator fan 16. As the indoor air passes through the evaporator and over the evaporator coil 14, the refrigerant absorbs the heat in the indoor air passing over the evaporator coil, thereby cooling the air and evaporating the refrigerant. The cooled air is circulated by the fan 16 back into the indoor area to be cooled.

After evaporation, the refrigerant vapor is drawn through the refrigerant circuit back to the compressor 11 wherein the refrigerant vapor is pressurized. The resulting hot, high-pressure vapor is circulated through the refrigerant circuit to the condenser wherein it passes through the condenser coil 12 in heat exchange relationship with ambient temperature outdoor air being passed over the condenser coil 12 by the condenser fan 18. As the outdoor air passes through the condenser over the condenser coil 12, the refrigerant rejects heat to the outdoor air passing over, thereby heating the air and condensing the high pressure refrigerant vapor to a high pressure liquid refrigerant. The high pressure liquid refrigerant leaving the condenser passes on through the refrigerant circuit traversing the expansion valve 13 wherein the high pressure refrigerant liquid is expanded to a lower temperature, lower pressure liquid, typically to a saturated liquid refrigerant before it enters the evaporator coil 14.

It should be understood that the expansion device 13 may be a valve such as a thermostatic expansion valve (TXV) or an electronic expansion valve (EXV) which regulates the amount of liquid refrigerant entering the evaporator coil 14 in response to the superheat condition of the refrigerant entering the compressor 11. It is also to be understood that the invention is equally applicable for use in association with other refrigerant vapor compression systems such as heat pump systems. In a heat pump, during cooling mode, the process is identical to that as described hereinabove. In the heating mode, the cycle is reversed with the condenser and evaporator of the cooling mode acting as an evaporator and condenser, respectively.

In accordance with the invention, a pair of sensors 20 and 30 is provided in operative association with the refrigerant circuit to measure variables needed for assessing the charge level in refrigerant vapor compression system 10. The sensor 20 is disposed in operative association with the refrigerant circuit to measure the refrigerant liquid pressure, $P_{liquid}$, in the refrigerant circuit at or closely downstream with respect to refrigerant flow of the outlet of the condenser coil 12. The sensor 30 is disposed in operative association with the refrigerant circuit to measure the refrigerant liquid temperature, $T_{liquid}$, downstream with respect to refrigerant flow of the outlet of the condenser coil 12 and upstream with respect to refrigerant flow of the expansion valve 13. The pressure sensor 20 may be a conventional pressure measuring device, such as for example a pressure transducer, and the temperature sensor 30 may be a conventional temperature sensor, such as for example a thermocouple, thermistor, or the like, mounted on the refrigerant line through which the refrigerant is circulating. The selection of the particular type of pressure sensor and temperature sensor employed is a matter of choice within the ordinary skill of the skilled practitioner in the art. Further, the particular type of pressure sensor or temperature sensor employed is not limiting of or germane to the invention.

In operation, the pressure sensor 20 generates and sends an analog voltage line 21 to an analog-to-digital converter 22 indicative of the measured refrigerant liquid pressure, $P_{liquid}$, and the temperature sensor 30 generates and sends an analog voltage signal to an analog-to-digital converter 32 indicative of the measured refrigerant liquid temperature, $T_{liquid}$. The analog-to-digital converter 22 converts the analog signal received from the pressure sensor 20 into a digital signal and outputs the resulting digital signal indicative of the measured refrigerant liquid pressure to a microprocessor 40. Similarly, the analog-to-digital converter 32 converts the analog signal received from the temperature sensor 30 into a digital signal and outputs that digital signal indicative of the measured refrigerant liquid temperature to the microprocessor 40.

The microprocessor 40 processes the digital output signals indicative of the measured refrigerant liquid pressure and the refrigerant liquid temperature and stores the processed data in a memory unit 42 in data communication with the microprocessor 40. The memory unit may be a ROM, an EPROM or other suitable data storage device. The memory unit 42 is preprogrammed with the pressure to temperature relationship charts characteristic of at least the refrigerant in use in the system 10. The microprocessor 40 reads the saturated liquid temperature, $T_{Lsat}$, for the refrigerant in use at the measured pressure, $P_{Liquid}$. Knowing the saturated liquid temperature, the microprocessor 40 calculates the actual degrees of subcooling, SC, using the following relationship:

$$SC=T_{Lsat}-T_{Liquid}.$$

The microcontroller 40 stores the actual degrees of subcooling in the memory unit 42.

The microprocessor 40 communicates with a service panel 50 for providing real-time output to a service technician. In a service mode, the microprocessor 40 provides output signals indicative of selected parameters which may be read at the service panel by the service technician to enable the service technician to know, in real-time, whether the system 10 is operating with the correct refrigerant charge, with too little of a refrigerant charge, or too much of a refrigerant charge. For example, the microprocessor 40 may be configured to provide digital signals to a digital-to-analog converter 44, operatively associated with both the microprocessor 40 and the service panel 50, indicative of various parameters known to the microprocessor, including the refrigerant liquid pressure, the refrigerant liquid temperature, the liquid saturation temperature and the actual degrees of subcooling. The digital-to-analog converter 44 converts each of the received digital signals to a respective milli-volt output signal and represents each milli-volt signal on a respective tap o52 on the service panel 50, thereby enabling the service technician to use a conventional voltmeter to read the real-time value for the various output parameters, including the refrigerant liquid pressure, the refrigerant liquid temperature, the liquid saturation temperature and the actual degrees of subcooling. The microprocessor 40 may also be configured to provide output signals to the digital-to-analog converter 44 for representation as milli-volt signals at the service panel 50 representative of various operating conditions that would typically also be known by the microprocessor, either from direct communication with the appropriate sensors or through communication with an associated system controller, such as the outdoor temperature, the outdoor humidity, the indoor temperature, the indoor humidity and other operating parameters associated with the measured subcooling value, all in real-time.

The microprocessor 40 also includes a control circuit for integrating the stored actual values of degrees of subcooling over a selected period of time to provide an average amount of subcooling over that selected time period. As the ambient operating conditions, e.g. outdoor temperature, outdoor humidity, indoor temperature and indoor humidity, etc., the amount of subcooling present at any given time during operation of the system 10 will vary over time. If these operating conditions vary widely, the amount of subcooling experienced during operation of the system 10 will also vary over a wide range. Thus, the amount of subcooling at any given point of operation may not be reflective of the true adequacy or inadequacy of the refrigerant charge over the full range of operating conditions experienced by the system 10 over a period of time.

Accordingly, in an indication mode, the microprocessor 40 provides output signals reflective of the system's refrigerant charge adequacy over a preprogrammed period of time of operation of the system. In an embodiment of the invention, the microprocessor 40 communicates with a charge status indicator panel 60 having a series of indicators, such as lights 62, 64 and 66, one of which is associated with an undercharge condition, one of which is associated with an over charge condition, and one of which is associated with a proper charge condition. The microprocessor 40 may be programmed to calculate and store the actual degrees of subcooling present at periodic time intervals, for example at one-hour intervals, and then from those stored valves calculate an average value for the degrees of subcooling over a selected period of operation, for example the last forty hours of operation.

In the depicted embodiment, the microprocessor 40 will compare this calculated average value for the degrees of subcooling to an acceptable range for the degree of subcooling from a low threshold level, for example 10° F., to a high threshold level, for example 15° F. If the average value for the degrees of subcooling is below the low threshold level, the microprocessor 40 will cause the indicator light 62 on the charge status indication panel 60 to illuminate thereby indicating that the refrigerant charge is too low. If the average value for the degrees of subcooling is above the high threshold level, the microprocessor 40 will cause the indicator light 66 on the charge status indication panel 60 to illuminate thereby indicating that the refrigerant charge is excessive. However, if the average value for the degrees of subcooling lies within the range of values lying between the low threshold level and the high threshold value, the microprocessor 40 will cause the indicator light 64 on the charge status indication panel 60 to illuminate thereby indicating that the refrigerant charge is acceptable.

The microprocessor 40 may be programmed to keep a running average value for the degrees of subcooling over the selected time interval. For example, every time the microprocessor 40 calculates a new real-time value for the degrees of subcooling based upon real-time measurements as hereinbefore described, the microprocessor 40 will discard the oldest stored value, substitute this latest calculated value for the discarded value and recalculate the average value for the selected time period. In this manner, the characterization of the refrigerant charge level indicated on the charge status indication panel 60 will always be up-to-date and represent the refrigerant charge adequacy over the last specified hours period of operation.

For a number of reasons, including human error, it is very difficult to charge a newly installed air conditioning system with the proper level of refrigerant charge. Thus, when initially charging a system, the field service technician will charge the system upon installation with an amount of refrigerant that results in a value for the degrees of subcooling that falls within a tolerance of a target value for degrees of subcooling at the current operating conditions. After the system has operated for a number of hours at equal to or exceeding the cumulative number of hours of operation over which the microprocessor 40 has been preprogrammed to base its calculation of an average value for degrees of subcooling upon, the field service technician will then return to check the charge status indicated on the charge status indication panel 60. If the charge status is indicated as being low or high, the service technician can take the appropriate corrective action to adjust the level of refrigerant charge in the system by either draining refrigerant from or adding refrigerant to the system. The charge status indicator panel 60 also provides a very convenient indication of refrigerant charge status to the service technician during periodic maintenance service of the system or during service calls. The charge status indicator panel also alerts the owner of the home or building with which the air conditioning system is associated of a potential refrigerant charge problem so that the service technician may be summoned.

While the present invention has been particularly shown and described with reference to a preferred embodiment as illustrated in the drawings, it will be understood by one skilled in the art that various changes in detail may be effected therein without departing from the true spirit and scope of the invention as defined by the claims. In particular, the present invention includes the equivalence of software and hardware in digital computing and the equivalence of digital and analog hardware in producing a particular output signal.

We claim:

1. A method for indicating a level of refrigerant charge in a refrigerant vapor compression system having a compressor, a condenser coil, an expansion device and an evaporator coil connected in serial relationship in refrigerant flow circuit, comprising:

sensing a pressure of the refrigerant leaving the condenser coil and generating a first signal indicative of a sensed refrigerant pressure;

sensing a temperature of the refrigerant downstream of the condenser coil and upstream of the expansion device and generating a second signal indicative of a sensed refrigerant temperature;

calculating in real-time a real-time value for the degrees of subcooling present based upon the sensed refrigerant pressure and the sensed refrigerant temperature;

outputting an electrical signal indicative of the real-time value for the degrees of subcooling present;

calculating an average value for the degrees of subcooling over a preselected time period of system operation; and outputting an indication of a refrigerant charge status over the preselected time period of system operation based on a step consisting of comparing the average value for the degrees of subcooling over the preselected time period to a threshold;

wherein said outputting the electrical signal indicative of the real-time value for the degrees of subcooling present comprises outputting a milli-volt electrical signal indicative of the real-time value for the degrees of subcooling present.

2. The method as set forth in claim 1 wherein outputting the indication of refrigerant charge status over the preselected time period of system operation comprises outputting an indication of whether the refrigerant charge status is low, high or correct.

3. The method as set forth in claim 1 wherein outputting the indication of refrigerant charge status over the preselected time period of system operation comprises:

providing an acceptable range for said average value for the degrees of subcooling over the preselected time period of system operation, said acceptable range extending from a lower threshold level to an upper threshold level;

comparing said average value for the degrees of subcooling over the preselected time period of system operation to said acceptable range for the degrees of subcooling over the preselected time period of system operation; and providing a refrigeration charge status indication reflecting one of: a low refrigerant charge if said average value for the degrees of subcooling over the preselected time period of system operation is below said lower threshold value, a high refrigerant charge if said average value for the degrees of subcooling over the preselected time period of system operation is above said upper threshold value, and a correct refrigerant charge if said average value for the degrees of subcooling over the preselected time period of system operation lies within said acceptable range.

4. The method as set forth in claim 3 wherein providing the refrigeration charge status indication reflecting one of the low refrigerant charge, the high refrigerant charge or the correct refrigerant charge comprises:

illuminating a first light indicating a low refrigerant charge if said average value for the degrees of subcooling over the preselected time period of system operation is below said lower threshold value, illuminating a second light indicating a high refrigerant charge if said average value for the degrees of subcooling over the preselected time period of system operation is above said upper threshold value, and illuminating a third light indicating a correct refrigerant charge if said average value for the degrees of subcooling over the preselected time period of system operation lies within said acceptable range.

5. Apparatus for indicating the level of refrigerant charge in a refrigerant vapor compression system having a compressor, a condenser coil, an expansion device and an evaporator coil connected in serial relationship in refrigerant flow circuit, comprising:

a pressure sensor for sensing the pressure of the refrigerant leaving the condenser coil and generating a first signal indicative of the sensed refrigerant pressure;

a temperature sensor for sensing the temperature of the refrigerant downstream of the condenser coil and upstream of the expansion device and generating a second signal indicative of the sensed refrigerant temperature;

a processor for calculating in real-time a value for the degrees of subcooling present based upon the sensed refrigerant pressure and the sensed refrigerant temperature and outputting an electrical signal indicative of the real-time value for the degrees of subcooling present and for calculating an average value for the degrees of subcooling over a preselected time period of system operation and outputting an indication of a refrigerant charge status based on a step consisting of comparing of the average value for the degrees of subcooling over the preselected time period of system operation to a threshold;

wherein said outputting the electrical signal indicative of the real-time value for the degrees of subcooling present comprises outputting a milli-volt electrical signal indicative of the real-time value for the degrees of subcooling present.

6. The apparatus as recited in claim 5 further comprising a service panel for receiving the electrical signal indicative of the real-time value for the degrees of subcooling present from said processor, said service panel having a tap at which the electrical signal indicative of the real-time value for the degrees of subcooling present is presented.

7. The apparatus as recited in claim 5 further comprising an indicator panel for receiving a signal indicative of the refrigerant charge status over the preselected time period of system operation; said indicator panel having a first indicator associated with a low refrigerant charge, a second indicator operatively associated with a high refrigerant charge, and a third indicator operatively associated with a correct refrigerant charge.

8. The apparatus as recited in claim 7 wherein:

said first indicator comprises a first light adapted to be illuminate for indicating a low refrigerant charge:

said second indicator comprises a second light adapted to be illuminated for indicating a high refrigerant charge; and said third indicator comprises a third light adapted to be illuminated for indicating a correct refrigerant charge.

9. Apparatus for indicating the level of refrigerant charge in an air conditioning system having a compressor, a condenser coil, an expansion device and an evaporator coil connected in serial relationship in refrigerant flow circuit, comprising:

a pressure sensor for sensing the pressure of the refrigerant leaving the condenser coil and generating a first analog signal indicative of the sensed refrigerant pressure;

a first analog-to-digital converter operatively associated with said pressure sensor for converting said first analog signal into a first digital signal;

a temperature sensor for sensing the temperature of the refrigerant downstream of the condenser coil and upstream of the expansion device and generating a second analog signal indicative of the sensed refrigerant temperature;

a second analog-to-digital converter operatively associated with said temperature sensor for converting said second analog signal into a second digital signal;

a microprocessor for receiving said first and second digital signals and calculating in real-time a value for the degrees of subcooling present based upon the sensed refrigerant pressure and the sensed refrigerant temperature and outputting an digital signal indicative of the real-time value for the degrees of subcooling present and for calculating an average value for the degrees of subcooling over a preselected time period of system operation and outputting an indication of a refrigerant charge status based on a step consisting of comparing the average value for the degrees of subcooling over the preselected time period of system operation to a threshold;

a digital-to-analog converter for converting the digital signal indicative of the real-time value for the degrees of subcooling present to a milli-volt electrical signal;

a service panel for receiving the milli-volt electrical signal indicative of the real-time value for the degrees of subcooling present from said processor, said service panel having a tap at which the milli-volt electrical signal indicative of the real-time value for the degrees of subcooling present is presented; and an indicator panel for receiving a signal from said microprocessor indicative of the refrigerant charge status over the preselected time period of system operation, said indicator panel having a first light adapted to be illuminate for indicating a low refrigerant charge, a second light adapted to be illuminated for indicating a high refrigerant charge, and a third light adapted to be illuminated for indicating a correct refrigerant charge.

* * * * *